US006138670A

United States Patent [19]

Delauze et al.

[11] Patent Number: 6,138,670

[45] Date of Patent: Oct. 31, 2000

[54] PROCESS AND INSTALLATION FOR UNDERWATER DIVING EMPLOYING A BREATHING MIXTURE CONTAINING HYDROGEN

[75] Inventors: Henri Delauze; Bernard Gardette, both of Marseilles; Claude Gortan, Allauch, all of France

[73] Assignee: Compagnie Maritime D' Expertises-Comex, Marseilles, France

[21] Appl. No.: 08/793,855

[22] PCT Filed: Aug. 11, 1995

[86] PCT No.: PCT/FR95/01083

§ 371 Date: Feb. 19, 1997

§ 102(e) Date: Feb. 19, 1997

[87] PCT Pub. No.: WO96/06771

PCT Pub. Date: Mar. 7, 1996

[30] Foreign Application Priority Data

Aug. 26, 1994 [FR] France ..... 94 10538

[51] Int. Cl.[7] ..... B63C 11/02

[52] U.S. Cl. ..... 128/201.27; 128/201.21

[58] Field of Search ..... 128/200.24, 201.21, 128/201.27, 201.28, 204.26

[56] References Cited

U.S. PATENT DOCUMENTS

| | | | |
|---|---|---|---|
| 3,730,178 | 5/1973 | Moreland | 128/201.21 |
| 3,807,396 | 4/1974 | Fischel | 128/201.21 |
| 3,831,594 | 8/1974 | Rein | 128/201.21 |
| 3,863,459 | 2/1975 | Rein | 128/201.21 |
| 3,941,124 | 3/1976 | Rodewald et al. | 128/201.21 |
| 4,026,283 | 5/1977 | Banjarich et al. | 128/201.27 |
| 4,181,126 | 1/1980 | Hendry | 128/201.21 |
| 4,206,753 | 6/1980 | Fife | 128/201.21 |
| 4,211,086 | 7/1980 | Leonard et al. | 128/201.21 |
| 4,269,791 | 5/1981 | Hills | 261/36 R |
| 4,362,154 | 12/1982 | Le Masson | 128/205.26 |
| 4,442,835 | 4/1984 | Carnegie | 128/201.27 |
| 4,951,660 | 8/1990 | Lubitzsch | 128/201.28 |
| 5,503,145 | 4/1996 | Clough | 128/201.27 |
| 5,678,542 | 10/1997 | Maffatone | 128/201.28 |
| 5,794,616 | 8/1998 | Cochran et al. | 128/201.27 |

FOREIGN PATENT DOCUMENTS

| | | |
|---|---|---|
| 499 164 | 4/1997 | Australia . |
| 2182230 | 12/1973 | France . |

*Primary Examiner*—Aaron J. Lewis
*Attorney, Agent, or Firm*—Wolf, Greenfield & Sacks, P.C.

[57] ABSTRACT

A process of pressurization, of supply for effecting a dive for underwater intervention with a breathing mixture with hydrogen, and of decompression of a person making the dive, wherein the person is pressurized to an absolute pressure $P_1$ of at least 0.45 MPa with a first type of breathing mixtures not containing hydrogen. The person is supplied at least from this pressure $P_1$ with a second type of breathing mixtures at pressure P as a function of the depth of dive p to which said person is lowered, which second breathing mixture is of hydreliox type containing hydrogen at a minimum partial pressure of 0.33 MPa, oxygen at less than 4% by volume, helium with a partial pressure of more than 0.1 MPa and other gases such a nitrogen with a total partial pressure of less than 0.09 MPa. Supplying this second type of hydrogenated breathing mixtures in accordance with a composition which would locate the dive in one of the zones of the high pressure nervous syndrome or of narcosis is avoided. The supply of the hydreliox mixture thus obtained is maintained at the pressure $P_2$ of the depth of dive p2 of the desired intervention and the person is authorized to make the desired intervention at this depth p2.

14 Claims, 4 Drawing Sheets

PROCESS AND INSTALLATION FOR UNDERWATER DIVING EMPLOYING A BREATHING MIXTURE CONTAINING HYDROGEN

The present invention has for its object processes and installations for underwater diving employing a breathing mixture containing hydrogen.

The technical sector of the invention is the domain of industrial underwater diving for operations at medium and great depth.

One of the principal applications of the invention is the possibility of making dives from installations ensuring the immersion and pressurization of divers down to a certain depth beyond 50 meters, and allowing the divers to carry out a given work safely and efficiently down to at least 650 meters, thanks to the use of a ternary gaseous mixture called hydreliox containing at least helium, oxygen and hydrogen, then in returning said divers to surface atmospheric pressure after a decompression phase.

The possibility of breathing a gaseous mixture containing hydrogen has in fact been known since the end of last century, but experiments on human divers were really carried out with such a gas only from 1944; since that time, trials have continued episodically and discontinuously, forming the subject matter, in certain cases, of publications. Such trials have in fact been continued up to the present time only within the framework of research on the physiological effects of hydrogen on man and have not allowed real industrial applications due to the numerous risks run, by reason of the explosive characteristics of such a mixture, the difficulty in manipulating it during diving, and certain reactions of non-habituation of the divers.

Yet hydrogen presents a very great interest, particularly for medium- and deep-diving, as, correctly dosed in the breathing mixture, it considerably attenuates certain undesirable effects generated by the pressure. In particular, the reduction, and even the disappearance, of the high-pressure nervous syndrome demonstrated in 1968 by X. FRUCTUS, R. NAQUET and R. BRAUER, on the one hand, and the reduction in the density of the breathing mixture, on the other hand (hydrogen is two times less dense than helium), avoid the divers' performances degrading as the depth increases.

In fact, it is known to adapt the type of breathing gas as a function of the depth of immersion, such as, generally: air, nitrox mixture ($N_2$, $O_2$), trimix mixture (He, $N_2$, $O_2$) and heliox mixture (He, $O_2$), but, despite the use of such synthetic mixtures, the divers undergo the effects of the hydrostatic pressure and of the non-metabolized gases (helium, nitrogen), as well as those associated with the increase in the density of the gas breathed under pressure. These various effects cause:

- physiological disorders defined by the high pressure syndrome grouping together various neurological, articular, digestive syndromes which reduce the divers' efficency;
- efforts in breathing which, on increasing proportionally with the depth, due to the increase in the density of the breathing mixture, all the higher as the molecular weight thereof is high, considerably reduce the divers' work capacity.

The experiments set forth hereinbefore, as described in the publications essentially intended for professionals and scientists, such as those of the UHMS (Undersea and Hyperbaric Medical Society) Publication reference No. 69 of Jan. 3, 1987 and entitled "Hydrogen as a diving gas" edited by Ralph W. BRAUER, and of the compilation of texts selected by this Undersea Medical Society in 1983, grouping together and entitled "Key documents of the biomedical aspects of deep sea diving" from 1608 (sic) to 1982, and some others, have made it possible to determine certain criteria of limit of use of gas mixtures containing at least hydrogen and oxygen at the same time, the latter being necessary for the divers to breathe: a risk of narcosis beyond 2.5 MPa of partial hydrogen pressure was noted in particular.

It has been envisaged fairly recently to add hydrogen in the basic binary mixture, well known and used industrially for numerous years and which, called heliox, is a mixture of helium and oxygen: in this way, a ternary mixture is obtained, mentioned hereinabove when presenting one of the principal applications of the invention, called hydreliox, which, during tests made in zones of depth accessible with heliox mixtures, showed that it very significantly improves the divers' efficiency and work capacity and consequently, their safety and the reliability of the underwater interventions made by humans. The hydreliox also enables the divers to intervene efficiently beyond the limits of diving with heliox located, on the industrial scale, towards 350/450 meters. With hydreliox, the record depth of less 701 meters was thus attained in 1992 at the Hyperbaric Test Centre under the control of Dr. X. FRUCTUS' team, admittedly in a hyperbaric simulator.

From these different experimental data which are often effected at the limit of the possibilities of the equipment and human capacities of the persons carrying out these experiments, therefore with some risks taken but compulsorily controlled permanently by doctors and scientists well acquainted with the problem, the objects of the present invention and the problem raised which it intends to solve, are those of determining in industrial, repetitive, reliable manner and in complete safety and by professionals, but not forcibly scientists, the criteria of use of the hydreliox mixtures, the optimum compositions thereof for carrying out work in complete safety and with the optimum efficiency, the processes of diving using these mixtures, the means for controlling and mastering the composition thereof, in particular with respect to the proportion of hydrogen and oxygen, and the installations allowing such dives.

Such objects are effectively attained by the present invention, in particular by a process of pressurization, of supply for making a dive for underwater intervention with a breathing mixture containing hydrogen, and of decompression of a person making such dive, according to which:

- said person is pressurized up to an absolute pressure $P_1$ of at least 0.45 MPa with a first type of breathing mixtures not containing hydrogen;
- said person is supplied, at least from this pressure $P_1$ with a second type of breathing mixtures at pressure P as a function of the depth of dive p at which said person is lowered, which second breathing mixture is of hydreliox type containing hydrogen at a minimum partial pressure of 0.33 MPa, oxygen at less than 4% by volume, helium at a partial pressure of more than 0.1 MPa, and other gases such as nitrogen with a total partial pressure less than 0.09 MPa;
- it is avoided to supply this second type of breathing mixtures containing hydrogen in a composition which would situate the dive in one of the zones of the high pressure nervous syndrome or of narcosis;
- the supply of the hydreliox mixture thus obtained is maintained at pressure P2 of the depth of dive p2 of the desired intervention and said person is authorized to make the desired intervention at this depth p2.

In the case, in order to effect said dive, of using an enclosure filled with breathing gas maintained at all times at the desired pressure P down to depth $p_2$, or in the case of mixed dive as defined hereinafter for taking up possible leaks of hydrogen which might be produced in the enclosure, or in the case of dive with saturation of hydrogen during the phase of decompression to modify the proportion of hydrogen in said enclosure, said mixture of gas contained therein is made to circulate in closed loop through at least one treatment circuit in which it is dehydrogenated before being returned into the enclosure; to that end, said breathing mixture is forced in said treatment circuit thanks to a circulator and the gaseous mixture is thus caused to traverse a catalytic oxidation reactor before the mixture of gas thus dehydrogenated is returned in said enclosure.

If it is desired to eliminate large quantities of hydrogen, i.e. essentially in the case of diving with saturation of a hydreliox gas, after having caused said gaseous mixture to traverse the catalytic oxidation reactor, the water resulting from oxidation with hydrogen, is condensed in a condenser and it is recovered in a volume distinct from the treatment circuit thanks to a separator, which makes it possible to return into said enclosure the mixture of gas not only dehydrogenated but also dehumidified.

In a preferred embodiment, in the event of closed loop supply of breathing gas, either from an enclosure or directly with the diver, in order to compensate his metabolic oxygen consumption, the necessary oxygen is added in the breathing mixture circulating in said closed loop towards the diver from an outside high-pressure reserve and through an oxygenator circuit such that: via a first safety valve, a buffer volume is filled with a given volume via the opening of an upstream charging valve, then, when the partial oxygen pressure in said breathing mixture which is then either that of said enclosure or that directly breathed by the diver, falls below a given threshold, the charging valve is closed and only then is the downstream discharge valve opened, through which the oxygen escapes into said mixture to be breathed, either towards the enclosure or directly in the closed supply loop of the diver, via at least one other safety valve.

In a particular diving mode, said person is pressurized and lowered in an enclosure which in this case is called a turret, until the desired pressure and depth $p_2$ are attained, using mixtures of breathing gas not containing hydrogen; such a non-hydrogenated mixture is maintained in said enclosure for the whole duration of the intervention then of decompression; said person is supplied with breathing mixture of hydreliox type with the aid of a circuit distinct from those supplying said enclosure, from the moment when the person must leave said enclosure to carry out his intervention and up to his return into this enclosure.

This diving process is called mixed diving, during which the breathing gas allowing pressurization and depressurization is not hydrogenated and may therefore be a known gas such as heliox, and the hydrogenated gas hydreliox is used solely for the duration of the intervention proper: in that case, if it is question of mixed dives but which are not called "at saturation" and which are in any case effected at a depth of intervention of more than 35 meters, a breathing mixture according to the present invention is such that it comprises oxygen at a proportion less than 4%, helium at a partial pressure of at least 0.1 MPa, hydrogen at the partial pressure of at least 0.33 MPa and at the most 1.8 MPa, and other possible gases such as nitrogen with a total partial pressure less than 0.09 MPa.

Within the framework of mixed dives as defined hereinabove, but during which there is saturation at least with helium, the breathing mixture hydreliox used responds to the same criteria of composition as those defined hereinabove, but, in addition, the proportion of hydrogen must be such that its partial pressure is always lower than 1.8 MPa for durations of exposure less than about six hours and preferably lower than 1.2 MPa for longer durations.

In a preferred mode of use for which the depth of intervention is beyond 50 meters, which is a more appropriate usage for such uses of hydreliox since this depth is the international limit authorized for diving with air, the partial pressure of hydrogen used is then at least 0.38 MPa. However, it may be considered that the interest of using such hydreliox gases intervenes only for dives for intervention beyond 70 meters, which then defines a partial pressure of hydrogen used of at least 0.5 MPa.

In the case of dives which are not in accordance with a mode of mixed diving as defined hereinabove, said diver will be pressurized from the initial minimum absolute pressure P1 as far as the depth of dive p2 for the desired intervention, supplying said person with the second type of breathing mixture of hydreliox type of which the pressure P is increased as a function of the equivalent depth of dive p to which this person is lowered: this second type of mixture of hydreliox type must at all times respect in its composition the rates and percentages of gas defined hereinabove and sufficient quantities of helium and hydrogen are added either simultaneously or alternately in order not to be situated in one of the zones of high pressure nervous syndrome or narcosis: after the desired intervention at said depth p2, the diver is decompressed by making him breath the same type of mixture of hydreliox gas which respects the previous proportions of composition and up to at the most the pressure P1 of 0.45 MPa from which the hydreliox mixture is replaced by any other type of non-hydrogenated breathing mixture.

It is in fact recalled, as this is known, that there exist two types of diving process, one which one is called bounce diving, and the other diving in saturation and for which the processes of the present invention may be applied in accordance with the different criteria set forth hereinbefore and hereinafter.

Bounce diving consists, after each immersion, in returning immediately afterwards to the surface at atmospheric pressure: it may be effected either in an independent diving suit with a reserve of high pressure gas carried by the diver, in "surface supply" for which the diver is connected to the surface by an umbilical cord which supplies him with breathing gas from a reserve of high pressure gas, in a wet turret called diving bubble equipped with a reserve of gas, or in a hyperbaric turret with decompression chamber on the surface.

Diving in saturation consists, for its part, in confining the divers in one or more hyperbaric chambers, generally located on the surface, at the hydrostatic pressure equivalent to the depth of the underwater worksite or operation: every day, the divers carry out an underwater intervention with transfer under pressure in an elevator turret; decompression to return to atmospheric pressure then intervenes only at the end of the work or authorized period of life in saturation. Diving in saturation involves the use of heavy equipment, such as hyperbaric chamber, turret, regeneration system, etc. . . . The qualification of state of saturation may be attributed to the types of dives exceeding a certain duration of intervention beyond which the phases of decompression are in any case identical, whatever the effective duration of dive; in this way, it may be considered that, in order to obtain a saturation with hydrogen, this gas must be breathed at the pressure of operation for at least 6 hours: a duration of breathing of this gas below this period will therefore not be considered as being saturation with this gas. The criteria of identical decompression curves are taken as practical limit of saturation, even if this does not correspond to what may be called physiological saturation of the tissues where there is as much non-consumed and therefore non-metabolized gas dissolved in the organism as in that which is breathed.

The results of the different processes, installations enabling said process as described hereinafter to be carried out and the types of breathing mixtures for the applications determined hereinabove, are thus novel and bring the answer to the problems and objectives defined hereinabove, while overcoming the various drawbacks raised by dives with hydrogen mixtures with the objectives of safety, reliability and efficiency of the diver at the desired depth of intervention, knowing that it may be considered that the practical limit for such industrial dives may be from 340 to 360 meters, even if the processes and installations according to the present invention allow dives up to 650 meters.

The following description and Figures represent examples of embodiment and of installation but have no limiting character, except concerning the diagram of the gaseous mixtures and process of diving which cover the whole of the domain covered by the present invention: other technical embodiments of installations are of course possible within the scope and extent of this invention, in particular depending on the type of diving used.

Figure 1:
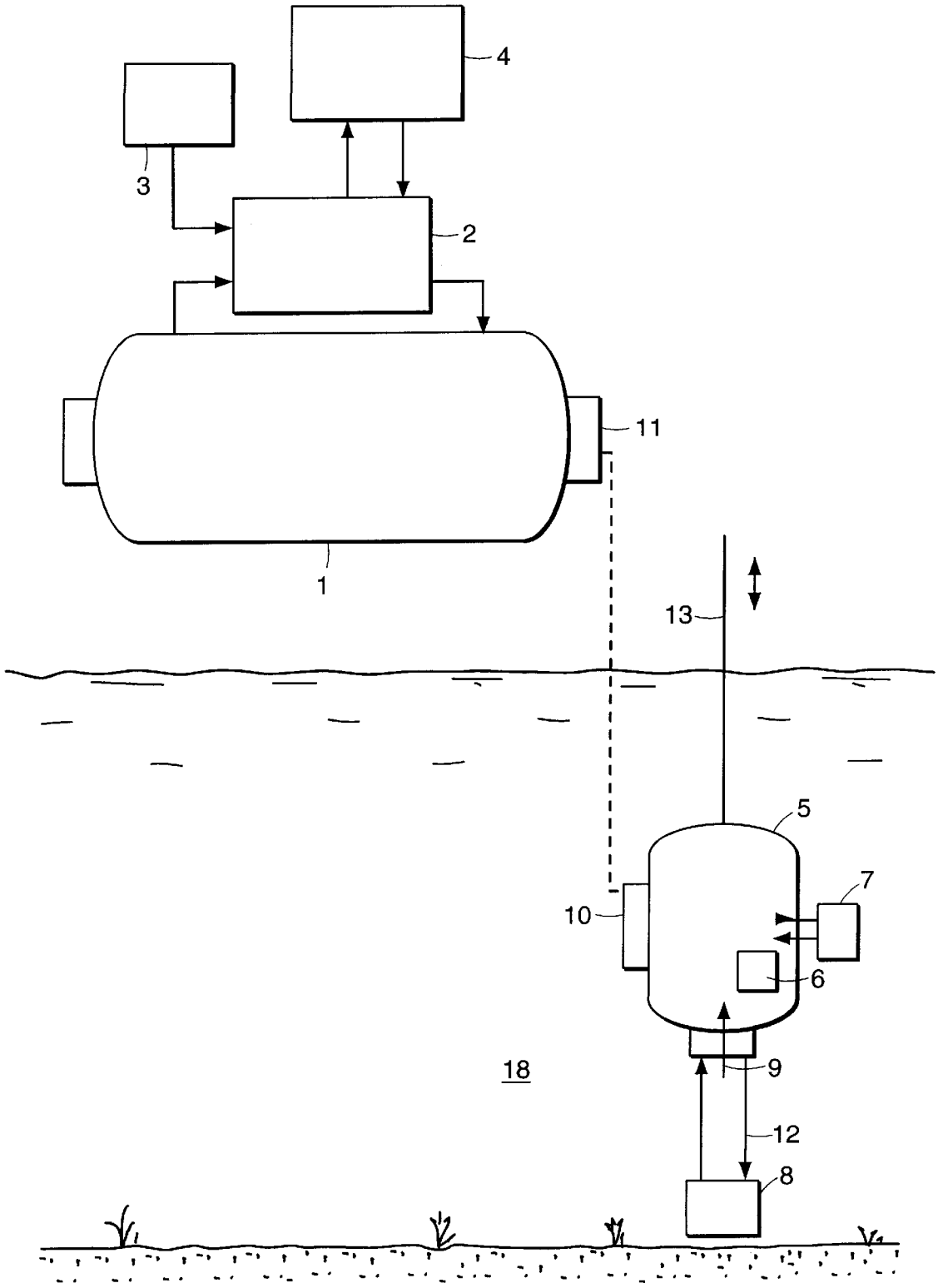
FIG. 1 is an overall skeleton diagram of a type of diving installation with intervention chamber and turret enabling the process of the present invention to be applied.

FIG. 1 represents an overall skeleton diagram of a type of diving installation known at the present time with an assembly of surface saturation enclosures 1, called decompression chambers, and an underwater enclosure 5 making it possible to lower the divers down to the desired depth such as a diving turret 5; this enclosure may also be what is called a diving bell in which the diver may shelter at least at the level of his head but who cannot be isolated from the medium in which it is located, contrary to a diving turret as shown in FIG. 1.

In fact, such a diving turret 5 comprises a lower door 9 which thus allows the diver who is the person 8 having to effect the intervention once brought to the desired diving pressure P2, 18, to leave the turret 5, said turret 5 remaining pressurized and filled with the breathing mixture having allowed such pressurization as far as this depth p2. The diver is then supplied via an umbilical cord 12:

- either with the same breathing mixture as that filling said turret 5, which makes it possible to reject therein the expired gases;
- or, in the case of mixed diving defined hereinabove, with a breathing mixture different from that existing in said diving turret or bell 5, this breathing mixture then being supplied by reserves embarked on said diving enclosure 5, or from the surface via an umbilical cord 13 connecting said enclosure to the surface: in that case, the gas expired by the diver is either rejected into the ambient medium by a so-called open circuit, or recovered in closed circuit thanks to a loop connecting it to the surface by said umbilical cord 13.

Figure 4:
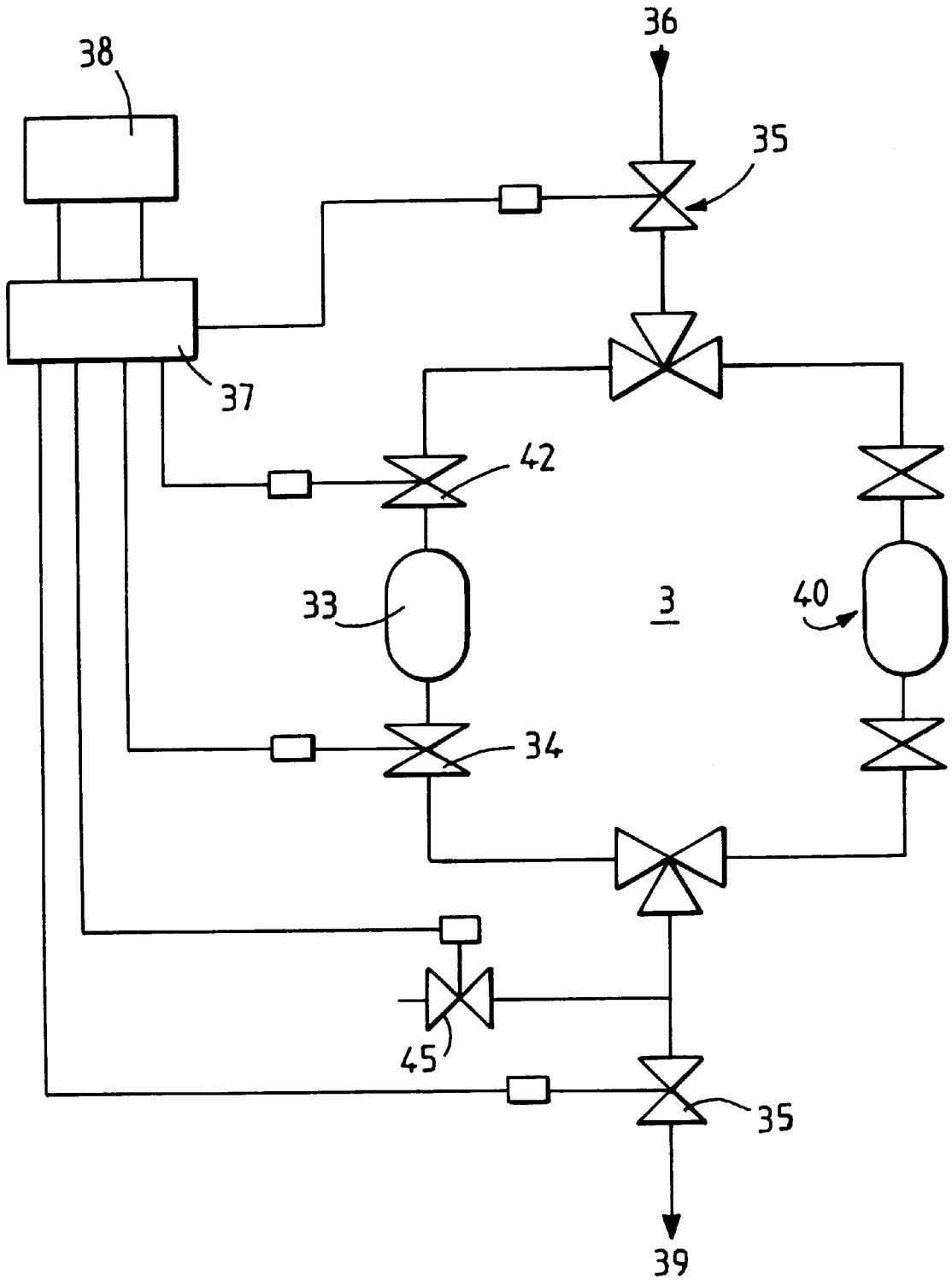
FIG. 4 is a diagram of an oxygenator according to the invention.

In the case of the supply loops in closed circuit and in any case for any confined enclosure, the breathing mixture is recycled by a treatment system which comprises in that case at least, on the one hand, known gas regeneration equipment for eliminating in particular the carbon dioxide and, on the other hand an oxygenator of the type shown in FIG. 4, specifically within the framework of supply of an enclosure, but which may be used in the case of a closed loop for oxygenating a breathing mixture independently of the enclosure.

Figure 3:
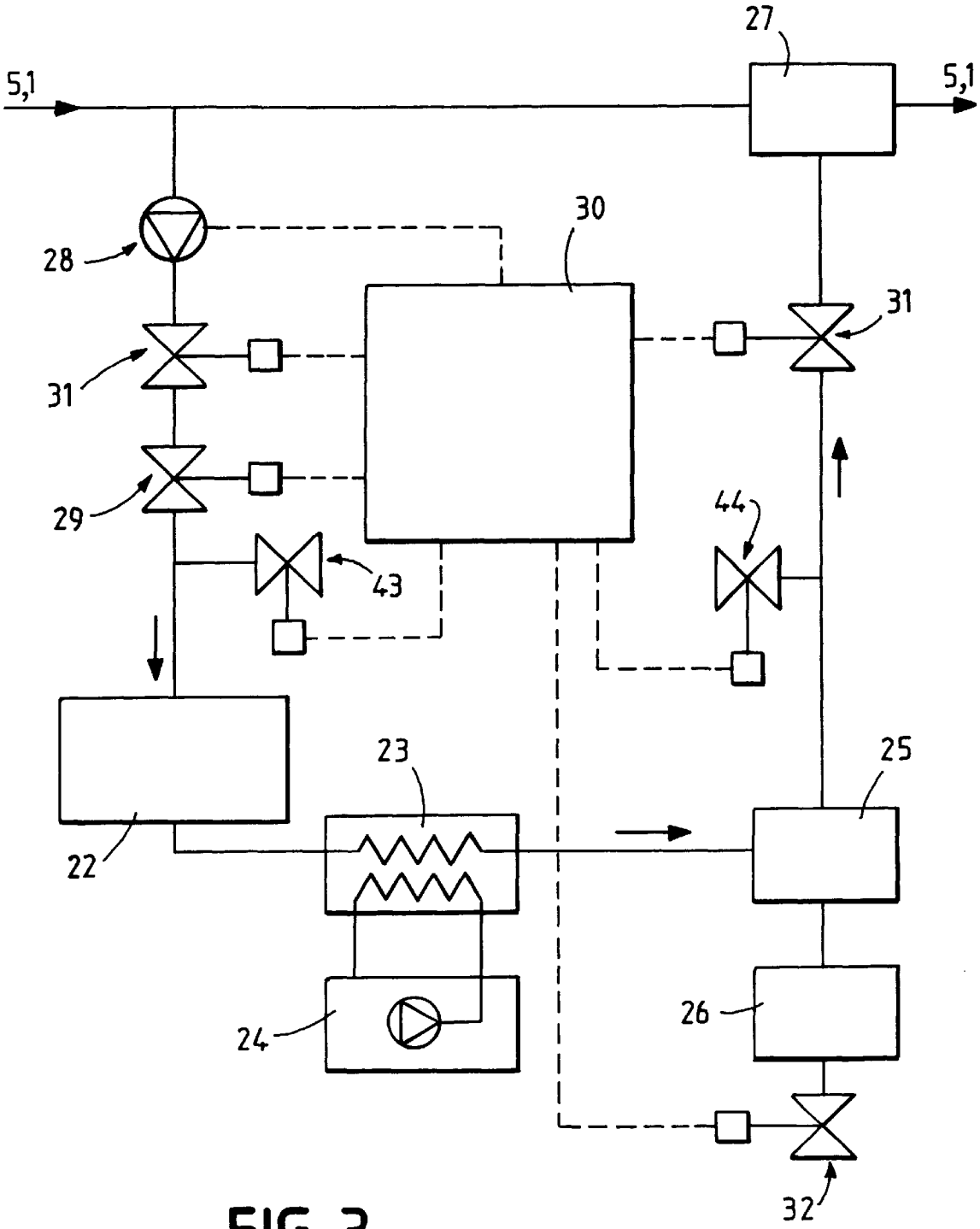
FIG. 3 is a diagram of a dehydrogenator according to the invention.

Said turret 5 shown in FIG. 1 may thus comprise an outer breathing loop 7 such as, precisely, an oxygenator shown in FIG. 4, and, inside its enclosure, in addition to known regeneration equipment, a dehydrogenator 6 as described in FIG. 3, especially within the framework of mixed diving, to eliminate any leak of hydrogen which might be released inside the enclosure 5 in order to maintain the breathing mixture thereof non-hydrogenated.

As indicated hereinabove, compression or decompression of the diver 8 up to and from the depth 18 may be effected in said turret 5 but at least decompression is preferably effected in a surface chamber 1, by hermetically connecting a side door 10 of said turret 5 returned to the surface after closure of the lower door 9 and maintained at the pressure of the depth 18, to another corresponding door 11 of said chamber.

The latter is associated with a regeneration system 2 of known type to which may be connected an oxygenator 3 of the type described in FIG. 4 and a dehydrogenator 4 such as the one described in FIG. 3.

Figure 2:
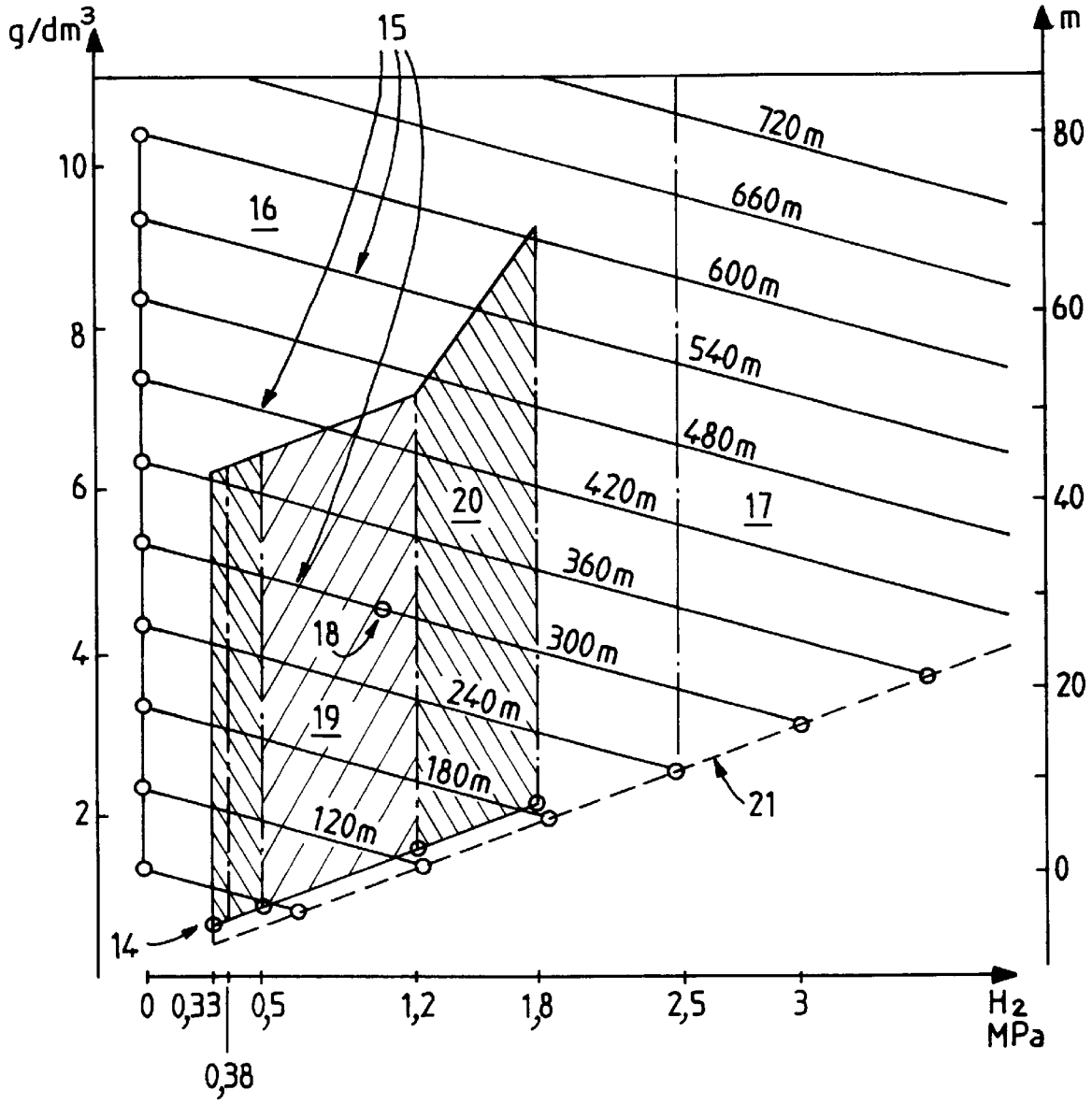
FIG. 2 is an assembly of curves representing the type of mixtures usable according to the present invention and explaining certain steps of processes thereof.

FIG. 2 on the one hand represents the different zones of breathing mixtures defined by the present invention and, on the other hand, enables the process of pressurization, supply and decompression according to the present invention to be explained: thus, zones 19 and 20 shown are those covering all the hydreliox breathing mixtures according to the invention with in particular zone 19 up to 1.2 MPa of partial pressure of hydrogen, preferably used for durations longer than six hours, and zone 20 being able to go up to 1.8 MPa for shorter exposure durations.

In fact, the diver is pressurized to an absolute pressure P1,14, of at least 0.45 MPa with a first type of breathing mixtures not containing hydrogen and said diver 8 is supplied at least from this pressure P1,14, with a second type of breathing mixtures at pressure P, function of the depth of diving p at which he is lowered; which second breathing mixture is of hydreliox type containing hydrogen at a minimum partial pressure of 0.33 MPa, oxygen at less than 4% by volume, helium with a partial pressure of more than 0.1 MPa and other gases such as nitrogen at a total partial pressure of less than 0.09 MPa. It is avoided, in final supply and/or during the compression phase upon the successive addition of the gases composing the mixture, supplying the second type of hydrogenated breathing mixtures in a composition which would locate the dive in one of the zones of the high-pressure nervous syndrome 16 or narcosis 17.

The final hydreliox mixture thus obtained is maintained at pressure $P_2$,18 of the depth of dive p2 of the desired intervention and said person or said diver is authorized to effect the desired intervention at this depth p2 by supplying him with this mixture.

Within the framework of a mixed dive, the pressure P1,14 is blended with the pressure P2,18, from which, for the intervention proper, said diver is supplied with the hydreliox mixture according to the invention; in the case of a non-mixed dive, said diver is supplied with hydreliox mixture from a pressure P1,14, less than the pressure of dive 18 and the pressure P of the breathing mixture is then increased as far as this equivalent depth of intervention 18 with hydreliox mixtures respecting the rates and percentages of gases of the present invention.

Curve 21 at the bottom of FIG. 2 below the zones 19, 20 of hydreliox mixtures according to the invention, is that of the known binary mixtures of oxygen and hydrogen. The x-axis of all these curves represents the partial pressures of hydrogen in Megapascal, and the y-axis represents to the left of the Figure the density of the breathing mixture obtained in grams per cubic decimeter and to the right, the equivalent in meters of water of the air mixtures having the same densities as those respected on the left-hand scale: it will thus be noted that, at 600 meters of dive in hydreliox mixture comprising a partial pressure of hydrogen of 1.8 MPa according to the present invention, at the limit of the zone 20 defined hereinabove, the diver in fact breathes a gas having a density equivalent to a dive with air at 70 meters.

Curves 15 in FIG. 2 represent for given identical depths, every 60 meters, by way of example, the variation of the density of breathing mixture according to the invention, as a function of the partial pressure of hydrogen that it contains and shown on the x-axis: these curves are of course decreasing and linear at constant temperature.

Following FIGS. 3 and 4 show diagrams of devices according to the invention making it possible, on the one hand, to be able to carry out the processes as defined hereinbefore and, on the other hand, to maintain the breathing mixtures according to the invention within the limits of composition indicated hereinabove.

In fact, FIG. 3 represents a dehydrogenator which makes it possible, either to modify as required the proportion of hydrogen in the saturation chamber 1 on the surface during the decompression phase for example, or to eliminate any leak of hydrogen in the case of mixed dive inside a diving enclosure or turret 5; this dehydrogenator may function alone or associated with a gas regenerator for eliminating the carbon dioxide for example. Said enclosure 1, 5, is connected to said dehydrogenator 4, 6 respectively which comprises at least one circulator which may be either a variable flow circulator 28, a circulator of the VENTURI 27 system type, or a combination of the two types. The dehydrogenation circuit also comprises at least one catalytic oxidation reactor 22 containing catalyst which may be based on platinum or palladium: the flow rate of gas traversing this reactor is controlled by an automatic valve 29 piloted by an electronic regulator 30, in order to maintain an optimum flowrate for the efficiency of said reactor. Its operational temperature is also controlled by this electronic regulator 30 and serves as decisive parameter for possibly automatically placing the dehydrogenator in safety in the event of exceeding the limiting temperature: in that case, the safety valves 31 are closed, isolating the whole of the circuit from the enclosure 1, 5, helium is injected via a valve 43 into said reactor 22 and said helium is bled via valve 44.

The characteristics of a dehydrogenator may make it possible to oxidize 20 $Nm^3$ of hydrogen under a service pressure which may attain 8 MPa with a reaction temperature of 500° C. Such a dehydrogenator may thus be installed in a diving turret 5 to eliminate any possible leak of hydrogen coming from a closed circuit supplying the diver with hydreliox for a mixed dive; however, if it is desired to eliminate large capacities of hydrogen, as in the case of an enclosure 1, 5 completely filled with the breathing gas which may contain hydrogen, in particular during the decompression phase, the water produced by said reactor 22 must be able to be eliminated: to that end, the circuit of the dehydrogenator then comprises a condenser 23 at the output of said reactor 22, connected to a cold unit 24 as well as to a water and gas separator 25 at the outlet of said condenser 23 which enables the water to be separated from the gaseous phase; this water is recovered in a volume 26 and is then evacuated by automatic monitoring of the level thanks to a bleed valve 32. Said electronic regulator 30 ensures monitoring of all of said valves 29, 31, 32, 43 and 44 as well as of circulators 27, 28, of the reactor 22, the condenser 23 and the cold unit 24, and of said separator 25.

Reoxygenation of the breathing mixture either in one of the two enclosures, surface 1 or diving 5, or also in the case of a closed loop as indicated above to compensate the metabolic consumption of oxygen of the divers 8, is ensured according to the invention by an oxygenator of which the diagram is shown in FIG. 4: said closed loop or said enclosure 1, 5 is then connected to an oxygenator 3 which comprises at least one buffer volume 33 filled with oxygen provided on one side with a charging valve 42 and on the other, with a discharge valve 34, as well as safety valves 35; which charging and discharge valves are piloted by a regulator 37 connected to a sensor 38 for measuring the proportion of oxygen in the enclosure 1, 5, or in the closed loop supplying said diver 8, and which opens the valve 34 when said proportion falls below a given threshold and only when the valve 42 is closed; reciprocally, said valve 42 may be opened only when the automatic discharge valve 34 is closed.

The opening time of said discharge valve 34 is a function of the difference between the reference point fixed on the regulator 37 and the value of oxygen read by the sensor 38 and regulator-analyzer 37 with a maximum time of opening less than half the time included between two measurements of oxygen: in this way, only a desired quantity of oxygen leaves (39) the oxygenator via the automatic safety valve 35, either towards the enclosure or in the closed loop and without there being any risk of accumulation of too high a proportion of oxygen at the same place in too short a time. The admission of oxygen 36 is ensured by storage bottles located outside said enclosure 1, 5, for example.

Moreover, for reasons of safety and guaranteed operation of the oxygen supply circuit, said buffer volume 33 may be doubled with a parallel circuit 40 in the event of one of the automatic charging and discharge valves 34, 42 breaking down.

Should the proportion of oxygen attain 4% in the zone of injection, the safety valves 35 close automatically and a discharge valve 45 opens to evacuate and expand, outside the enclosure or the closed loop, the zone upstream of the discharge safety valve 35; in the event of stoppage of operation and for safety reasons, these valves can then be reset only manually, in the same way as the switching of one of the parallel circuits 33 and 40 to the other.

We claim:

1. A process for pressurizing and supplying breathable mixtures of gases to a person during a dive, said process comprising the steps of:

providing a first breathable mixture of gases containing no hydrogen;

increasing an absolute pressure of the first breathable mixture of gases to at least about 0.45 MPa;

after said increasing step, providing at least a second breathable mixture of gases at an absolute pressure increasing with depth of dive, the second breathable mixture of gases containing hydrogen having a minimum partial pressure of about 0.33 MPa and a maximum partial pressure of about 2.5 MPa, oxygen at less than about 4% by volume, helium having a partial pressure of more than about 0.1 MPa and other gases having a total partial pressure of less than about 0.09 MPa; and maintaining an absolute pressure of the second breathable mixture at at least about 0.45 MPa at a depth of an underwater site.

2. The process according to claim 1, wherein the second breathable mixture contains hydrogen with a maximum partial pressure of about 1.8 MPa.

3. The process according to claim 1, further comprising the steps of:

supplying the mixtures of breathable gases to at least one enclosure; and dehydrogenating the mixtures of breathable gases by circulating the mixtures in a closed loop from the enclosure, through at least one treatment circuit, and back to the enclosure.

4. The process according to claim 3, wherein said step of dehydrogenating further comprises the steps of:

circulating the mixtures of breathable gases by a circulator; and passing the mixtures of breathable gases through a catalytic oxidation reactor.

5. The process according to claim 4, wherein said step of dehydrogenating further comprises the steps of:

condensing water in a condenser resulting from said passing step; and recovering the condensed water by a separator distinct from the treatment circuit.

6. The process according to claim 1, further comprising the steps of:

during decompression, providing a least a third breathable mixture of gases, said third breathable mixture of gases containing hydrogen having a minimum partial pressure of about 0.33 MPa and a maximum partial pressure of about 2.5 MPa, oxygen at less than about 4% by volume, helium having a partial pressure of more than about 0.1 MPa and other gases having a total partial pressure of less than about 0.09 MPa;

decreasing an absolute pressure of the third breathable mixture of gases to at least about 0.45 MPa; and after said decreasing step, providing at least a fourth breathable mixture of gases containing no hydrogen.

7. The process according to claim 6, wherein the third breathable mixture of gases contains hydrogen with a maximum partial pressure of about 1.8 MPa.

8. The process according to claim 6, further comprising the steps of:

supplying the mixtures of breathable gases to at least one enclosure; and dehydrogenating the mixtures of breathable gases by circulating the mixtures in a closed loop from the enclosure, through at least one treatment circuit, and back to the enclosure.

9. The process according to claim 1, further comprising the step of:

compensating for the metabolic consumption of oxygen with an oxygenator.

10. The process according to claim 9, wherein said compensating step further comprises the steps of:

opening a charging valve connected to a buffer volume;

filling the buffer volume with oxygen from an outside high-pressure reserve;

sensing the partial pressure of oxygen in the breathable mixtures of gases; and when the partial pressure of oxygen descends below a given threshold in the breathable mixtures of gases , closing the charging valve and opening a discharge valve connected to the buffer volume to pass oxygen from the buffer volume into the breathable mixtures of gases.

11. A process for supplying breathable mixtures of gases to a person during a dive, the process comprising the steps of:

maintaining a first, non-hydrogenated breathable mixture of gases in an enclosure; and providing a second breathable mixture of gases in a separate circuit permitting exit from and entrance to the enclosure, the second breathable mixture of gases containing hydrogen having a minimum partial pressure of about 0.33 MPa and a maximum partial pressure of about 2.5 MPa, oxygen at less than about 4% by volume, helium having a partial pressure of more than about 0.1 MPa and other gases having a total partial pressure of less than about 0.09 MPa.

12. The process according to claim 11, wherein the second breathable mixture of gases contains hydrogen with a maximum partial pressure of about 1.8 MPa.

13. An installation for supplying breathable mixtures of gases to a person during a dive, the installation having a dehydrogenator which controls the proportion of hydrogen in an enclosure, the dehydrogenator comprising:

at least one circulator which circulates the mixture;

a catalytic oxidation reactor connected to the circulator;

a condenser connected to the oxidation reactor and to a cooling unit;

a water and gas separator connected to the condenser;

safety valves which isolate the enclosure from the dehydrogenator when a limiting temperature is exceeded; and an electronic regulator for monitoring all of said valves, circulator, reactor, condenser and separator.

14. An installation for supplying a breathable mixture of gases to a person during a dive, the installation having an oxygenator which compensates for the metabolic consumption of oxygen in an enclosure, the oxygenator comprising:

a buffer volume having a charging valve which allows the buffer volume to be filled with oxygen from an outside high-pressure reserve and a discharge valve which allows the oxygen from the buffer volume to be discharged into the breathable mixture of gases; and at least one safety valve downstream of the discharge valve to prevent an excessive accumulation of oxygen;

wherein when the partial pressure of oxygen descends below a given threshold, the charging valve is closed and the discharge valve is opened allowing oxygen to be discharged into the breathable mixture of gases.

* * * * *